US009629507B1

(12) United States Patent
Solomon

(10) Patent No.: US 9,629,507 B1
(45) Date of Patent: Apr. 25, 2017

(54) CHILD WATER SAFETY APPARATUS

(71) Applicant: Donna Solomon, Timmins (CA)

(72) Inventor: Donna Solomon, Timmins (CA)

( * ) Notice: Subject to any disclaimer, the term of this patent is extended or adjusted under 35 U.S.C. 154(b) by 60 days.

(21) Appl. No.: 14/601,925

(22) Filed: Jan. 21, 2015

(51) Int. Cl.
*A47K 3/024* (2006.01)
*A47K 3/12* (2006.01)

(52) U.S. Cl.
CPC ..... *A47K 3/127* (2013.01)

(58) Field of Classification Search
CPC ..... A47K 3/024; A47K 3/034; A47K 3/074; A47K 3/12; A47K 3/127; A47K 3/14; A47K 3/164; B65D 11/1866; B65D 11/1873
USPC ..... 4/572.1, 586, 587, 655, 900; 5/655, 900, 5/93.1–93.2, 99.1
See application file for complete search history.

(56) References Cited

U.S. PATENT DOCUMENTS 1,856,992 A * 5/1932 Gaddess ..... A47K 3/064 4/594
2,869,750 A * 1/1959 Doerr ..... B65D 88/528 206/512
3,572,535 A * 3/1971 Kinzie ..... B65D 11/1873 220/4.33
4,117,558 A 10/1978 Poth
6,243,890 B1 6/2001 Yang
6,314,592 B1 * 11/2001 Stein ..... A47K 3/127 4/572.1
6,910,574 B2 * 6/2005 Straka ..... B65D 9/18 206/315.1
2012/0151688 A1 * 6/2012 Jang ..... D06F 37/203 8/137
2014/0352053 A1 * 12/2014 Conohan ..... A01K 13/001 4/559
2016/0007809 A1 * 1/2016 Patty ..... A47K 3/14 4/572.1

* cited by examiner

*Primary Examiner* — Paul R Durand
*Assistant Examiner* — Nicholas Ros
(74) *Attorney, Agent, or Firm* — Stevenson IP, LLC

(57) ABSTRACT

A child water safety apparatus is made from a base that includes four side panels attached perpendicularly to the sides of the base. Each of the side panels is removably attached to each of the base and the respective adjacent side panel via a lock unit. A plurality of suction cups on the base anchor the apparatus to a bottom surface of a bathtub for use. A plurality of holes is evenly dispersed in each of the side panels and the base to allow uniform water levels within and without the apparatus. The base preferably has dimensions of twenty-four inches by eighteen inches, thereby allowing an infant sufficient room to move within the apparatus while preventing the infant from falling over and potentially drowning.

6 Claims, 4 Drawing Sheets

CHILD WATER SAFETY APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of child water safety apparatus are in use and are known in the prior art. However, most child water safety apparatus do not provide a fun, water-filled environment that also takes into account safety concerns. The child water safety apparatus herein includes safety features that ensure that an infant is safe and secure, but also provides for a fun, water-filled environment when the infant is taking a bath.

FIELD OF THE INVENTION

Various types of child water safety apparatus are in use and are known in the prior art. Existing child water safety apparatus typically are not sufficiently high enough, allowing toys and washcloths to float away from an infant when the apparatus is in use. Other apparatus do not have sufficient porosity to allow enough water to enter the apparatus, thereby creating a differential pressure that makes moving the apparatus hard at times. Furthermore, some apparatus do not have safety features that prevent the infant from easily moving about or preventing the apparatus itself from being easily moved around. The present invention utilizes all of these characteristics in one child water safety apparatus and as a result, provides a combination of characteristics that are not seen in the prior art.

SUMMARY OF THE INVENTION

The child water safety apparatus is made from a base that includes four side panels attached to the sides of the base at ninety degree angles. Each of the side panels are removably attached to the base via a lock unit and removably attached to each adjacent panel by at least one lock unit as well. The base has a number of suction cups anchor the child water safety apparatus to the bottom surface of a bathtub when in use. A plurality of holes are evenly dispersed within each of the four side panels and the base for uniform water levels within and without the apparatus. The base preferably has dimensions of twenty-four inches by eighteen inches, thereby allowing an infant sufficient room within the apparatus while preventing the infant from falling over and potentially drowning.

DETAILED DESCRIPTION OF THE DRAWINGS

Figure 1:
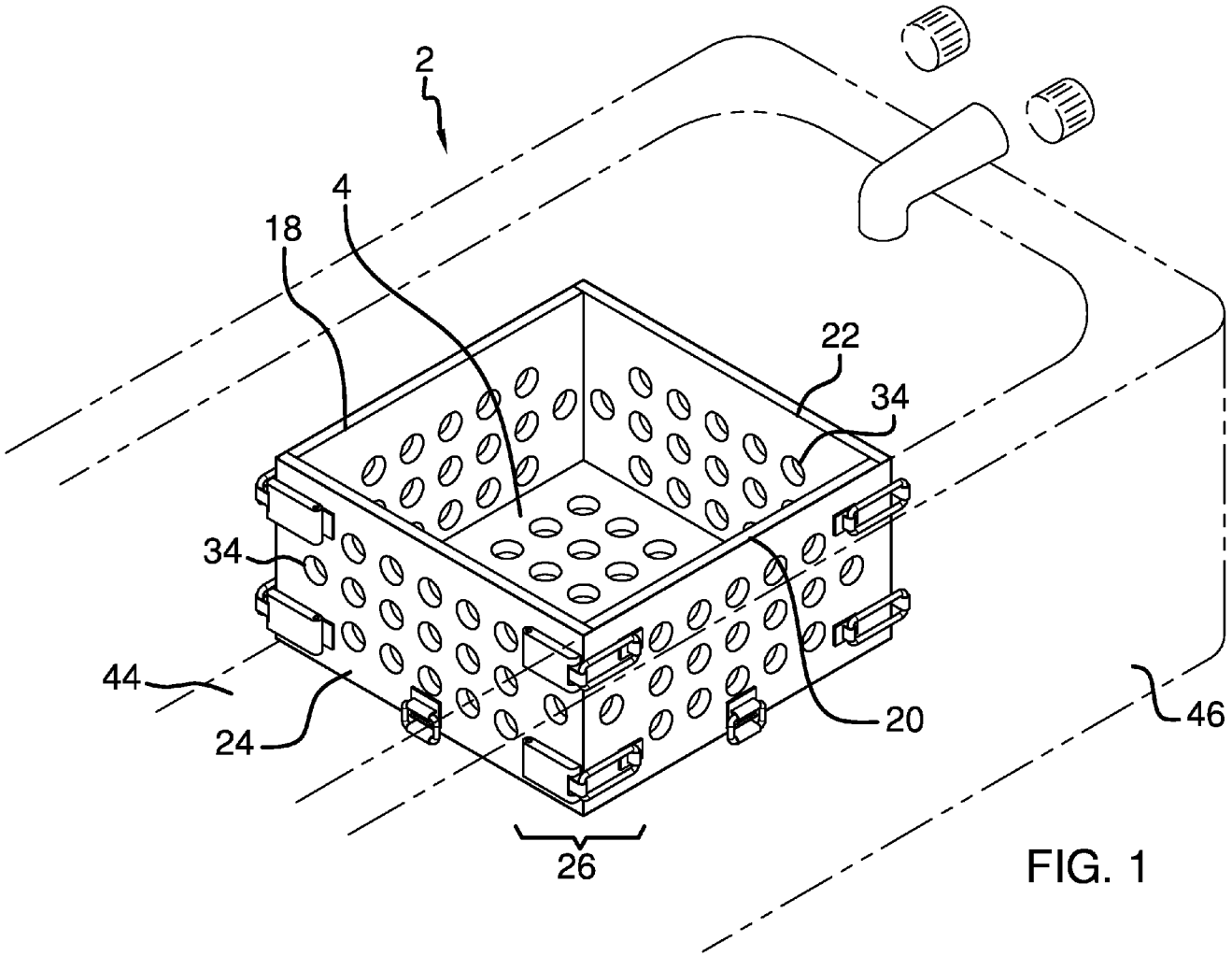
FIG. 1 is an isometric view.
Figure 2:
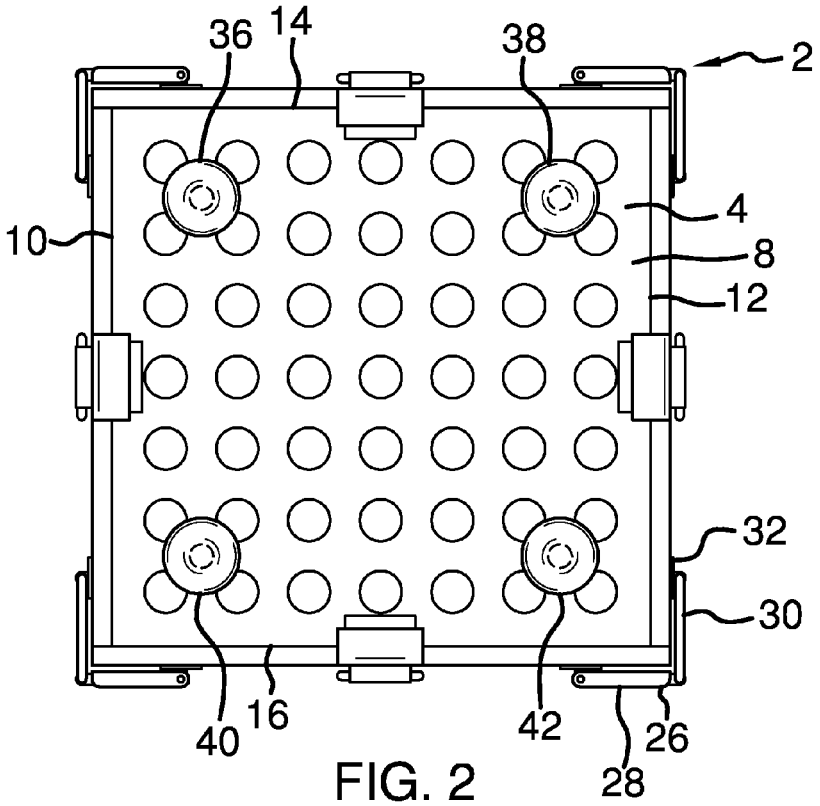
FIG. 2 is a bottom plan view.
Figure 3:
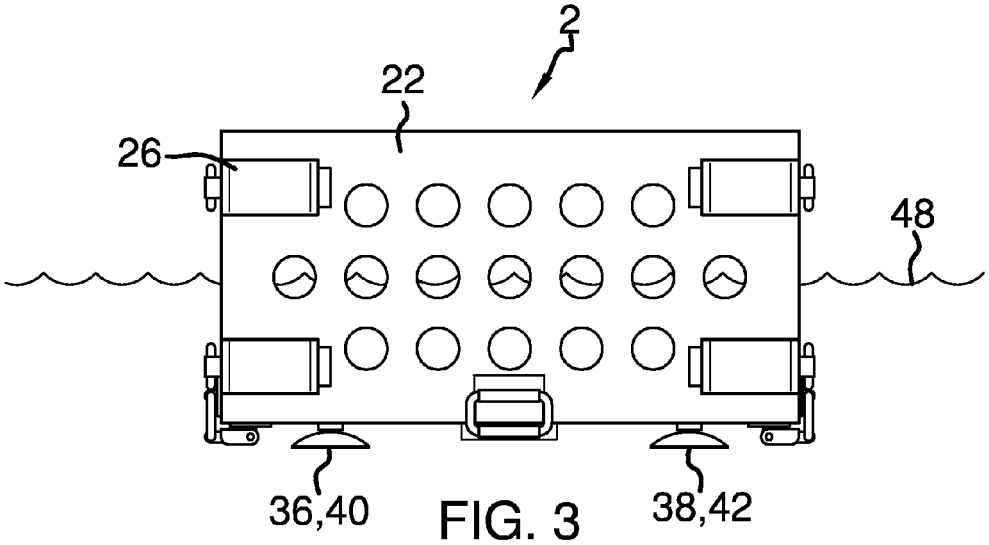
FIG. 3 is a front elevation view.
Figure 4:
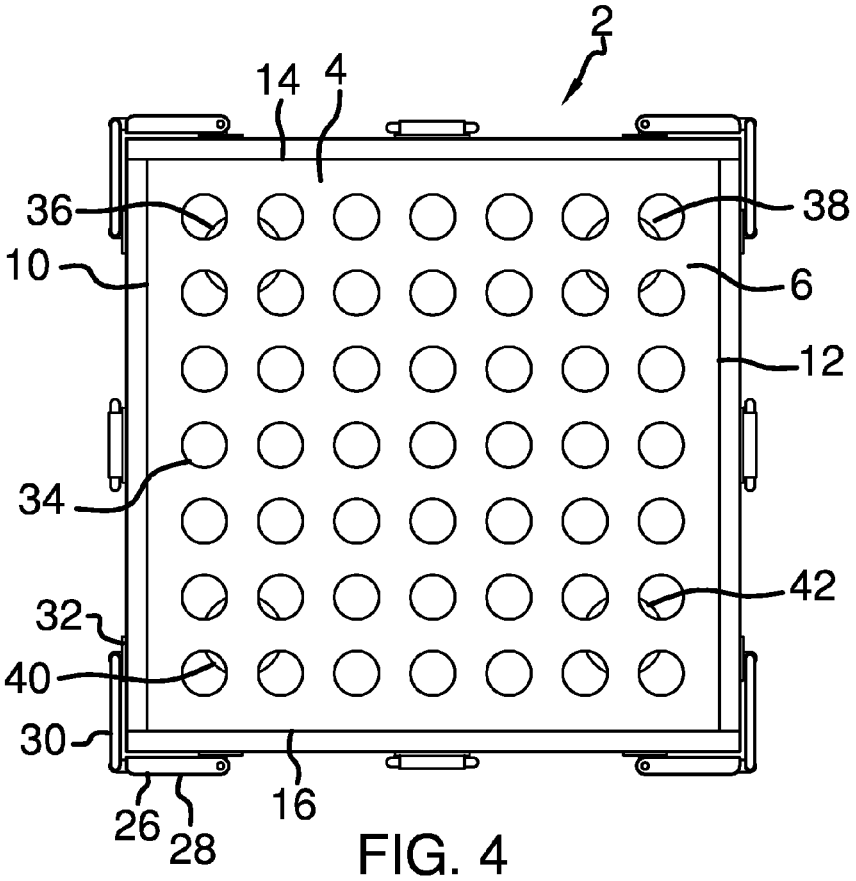
FIG. 4 is a top plan view.
Figure 5:
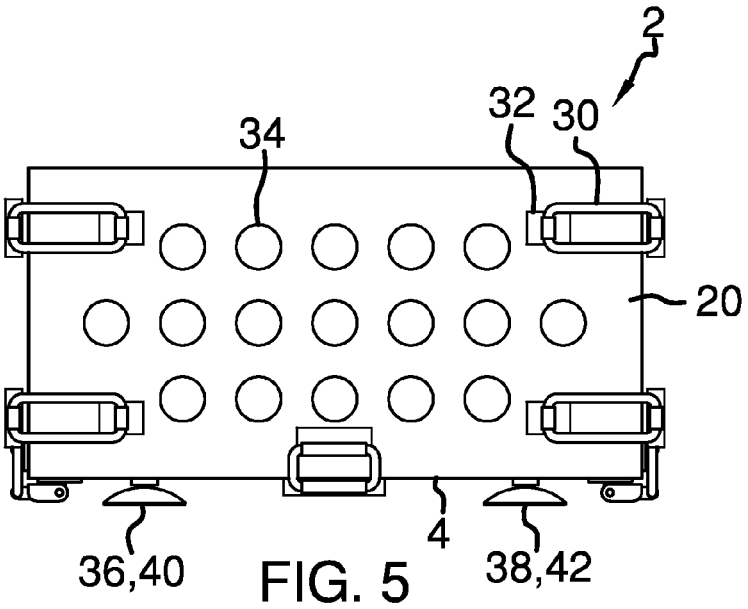
FIG. 5 is a side elevation view.
Figure 6:
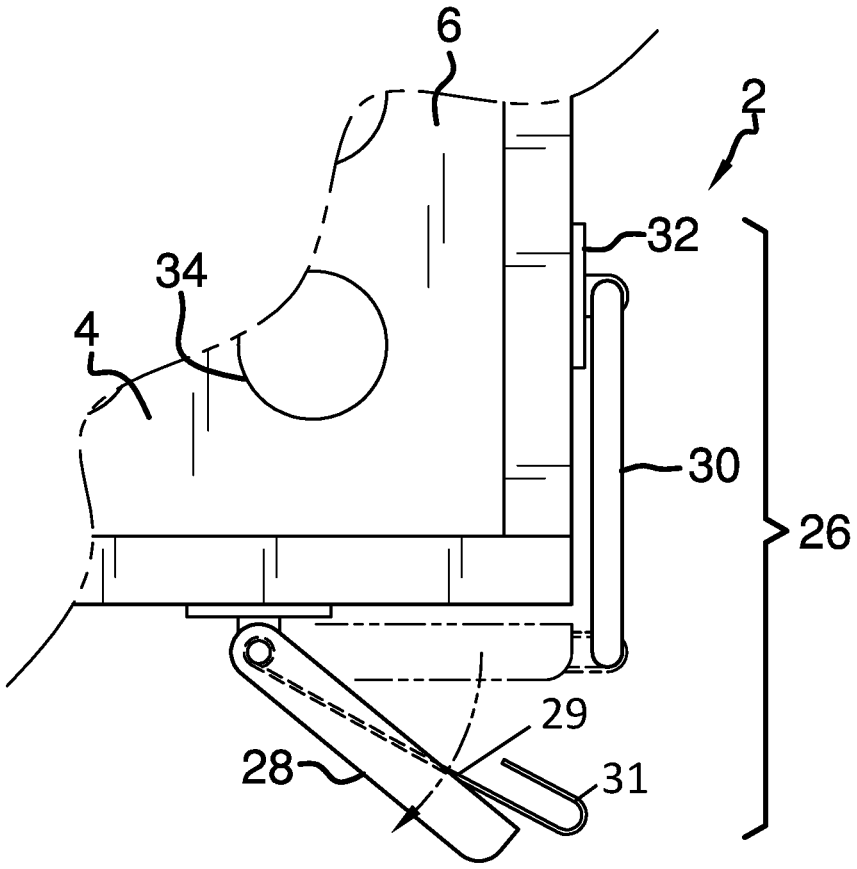
FIG. 6 is a detail view of a lock unit.

With reference now to the drawings, and in particular FIGS. 1 through 6 thereof, an example of the child water safety apparatus employing the principles and concepts of the present invention and generally designated by the reference number 2 will be described.

Referring to FIGS. 1 through 6, a preferred embodiment of the present invention is disclosed. The child water safety apparatus 2 disclosed herein includes a base 4 that has an upper surface 6 and a lower surface 8. Furthermore, the base 4 also has four side edges comprising a left side edge 10, a right side edge 12, a front side edge 14, and a rear side edge 16. Preferably, the base 4 is 24 inches in length and 18 inches in width, with the left side 10 and the right side 12 being the longest two sides, but the base 4 can also be rectangular, as shown in FIGS. 1-6.

Child water safety apparatus 2 also has four side panels comprising a left side panel 18, a right side panel 20, a front side panel 22, and a rear side panel 24. Left side panel 18 is placed against the left side edge 10 at a ninety degree angle, while right side panel 20 is placed against the right side edge 12 at a ninety degree angle. Furthermore, front side panel 22 is placed against the front side edge 14 at a ninety degree angle, while rear side panel 24 is placed against the rear side edge 16 at a ninety degree angle. The panels abut one another and form a box-like structure when the panels are in a locked position.

A plurality of lock units 26 are used to maintain all of the panels 18-26 in the locked position. Each lock unit 26 includes a base plate 28 that is pivotably disposed on a particular one of the left side panel 18, the right side panel 20, the front side panel 22, and the rear side panel 24, a pivoting arm 29 disposed on the base plate 28, a hook 31 externally disposed on the pivoting arm 29 a receiving unit 32 disposed on an adjacent one of the left side panel 18, the right side panel 20, the front side panel 22, and the rear side panel 24, and a pivotable clasp 30 affixed to each receiving unit 32. The pivotable clasp 30 of a particular lock unit 26 is removably fastenable into a locked position with the hook of the pivoting arm 29 of the respective adjacent base plate, thereby securing two of the adjacent side panels together.

Preferably, a dozen lock units 26 are provided with the child water safety apparatus 2. Four of the lock units 26 have the base plates 28 disposed on the rear side panel 24, with two of the associated receiving units 32 being disposed on the left side panel 18 and the other two associated receiving units 32 being disposed on the right side panel 20. Another four of the lock units 26 have the base plates 28 disposed on the front side panel 22, with two of the associated receiving units 32 being disposed on the left side panel 18 and the other two associated receiving units 32 being disposed on the right side panel 20. The final four lock units 26 have the base plates 28 disposed on the lower surface 8 of the base 4, with the four associated receiving units 32 each being disposed on one of the four side panels 18-26.

Each of the base 4 and the side panels 18-26 has a plurality of holes 34 of uniform size, which are evenly dispersed, to allow for porosity of the present apparatus 2 which, in turn, allows an infant to sit in the child water safety apparatus 2 and allows water to flow in and out of the child water safety apparatus 2. The holes 34 are aligned in straight columns and rows.

The base 4 also has a quartet of suction cups 36, 38, 40, 42 attached to the lower surface 8 of the base 4. These suction cups 36-42 are designed to provide extra attachment power to allow the base 4 to be attached to the bottom surface 44 of a bathtub 46 when water 48 is placed within the bathtub 46.

What is claimed is:

1. A child water safety apparatus comprising:

a base having an upper surface and a lower surface, the base also having four side edges comprising a left side edge, a right side edge, a front side edge, and a rear side edge;

a quartet of side panels comprising a left side panel, a right side panel, a front side panel, and a rear side panel;

wherein each of the left side panel, the right side panel, the front side panel, and the rear side panel is disposed perpendicularly against the left side edge, the right side edge, the front side edge, and the rear side edge at a ninety degree angle, respectively;

wherein the panels abut one another and form a box-like structure;

a plurality of lock units, wherein each lock unit comprises a base plate pivotably disposed on one of each of the side panels and each of the front side edge and the rear side edge of the base;

a pivoting arm pivotably disposed on the base plate;

a hook externally disposed on the pivoting arm;

a receiving unit disposed on an adjacent one of the respective side panels in a position adjacent the receiving unit;

a pivotable clasp affixed to each receiving unit, wherein each pivotable clasp is engageable to the hook of the pivoting arm of the respective adjacent base plate;

wherein upon the removable attachment of the pivotable clasp to the respective pivoting arm, one of the side panels and the respective side panel adjacent thereto are locked together;

a plurality of suction cups attached to the lower surface of the base, wherein each of the suction cups is attachable to a bottom surface of a bathtub; and a plurality of holes on the base and each of the side panels.

2. The child water safety apparatus of claim 1 wherein the base has a height of twenty-four inches and a width of eighteen inches.

3. The child water safety apparatus of claim 2 wherein the plurality of lock units further comprises:

a plurality of lock units;

wherein the base plates of four lock units of the plurality of lock units are disposed on the rear side panel, wherein two of the receiving units associated with the base plates disposed on the rear side panel are in operational communication with the left side panel, wherein the two remaining receiving units associated with the base plates disposed on the rear side panel are in operational communication with the right side panel;

wherein the base plates of four lock units are disposed on the front side panel, wherein two of the receiving units associated with the base plates disposed on the front side panel are in operational communication with the left side panel, wherein the two remaining receiving units associated with the base plates disposed on the front side panel are in operational communication with the right side panel;

wherein the base plates for four lock units are disposed on the lower surface of the base, wherein each receiving unit associated with the base plates disposed on the lower surface of the base is attached is in operational communication with the left side panel, wherein the two remaining receiving units associated with the base plates disposed on the front side panel is in operational communication with one of the side panels of the quartet of side panels; and wherein each of the lock units removably attaches the panel or base to which the base plate is in operational communication with the adjacent panel on which the receiving unit is disposed.

4. The child water safety apparatus of claim 3 wherein the plurality of suction cups comprises four suction cups.

5. The child water safety apparatus of claim 4 wherein the holes on each of the base and the side panels are evenly dispersed.

6. A child water safety apparatus consisting of:

a base having an upper surface and a lower surface, the base also having four side edges comprising a left side edge, a right side edge, a front side edge, and a rear side edge;

a quartet of side panels comprising a left side panel, a right side panel, a front side panel, and a rear side panel;

wherein each of the left side panel, the right side panel, the front side panel, and the rear side panel is disposed perpendicularly against the left side edge, the right side edge, the front side edge, and the rear side edge at a ninety degree angle, respectively;

wherein the panels abut one another and form a box-like structure;

a plurality of lock units, wherein each lock unit comprises a base plate pivotably disposed on one of each of the side panels and each of the front side edge and the rear side edge of the base;

a pivoting arm pivotably disposed on the base plate;

a hook externally disposed on the pivoting arm;

a receiving unit disposed on an adjacent one of the respective side panels in a position adjacent the receiving unit;

a pivotable clasp affixed to each receiving unit, wherein each pivotable clasp is engageable to the hook of the pivoting arm of the respective adjacent base plate;

wherein upon the removable attachment of the pivotable clasp to the respective pivoting arm, one of the side panels and the respective side panel adjacent thereto are locked together;

a quartet of suction cups attached to the lower surface of the base, wherein each of the suction cups is attachable to a bottom surface of a bathtub; and a plurality of holes on the base and each of the side panels, wherein the holes on each of the base and the side panels are evenly dispersed and aligned in straight columns and rows.

* * * * *